US009890437B2

(12) United States Patent
Kakiuchi et al.

(10) Patent No.: US 9,890,437 B2
(45) Date of Patent: Feb. 13, 2018

(54) HIGH-STRENGTH STEEL SHEET WITH EXCELLENT WARM FORMABILITY AND PROCESS FOR MANUFACTURING SAME

(71) Applicant: Kobe Steel, Ltd., Kobe-shi (JP)

(72) Inventors: Elijah Kakiuchi, Kobe (JP); Toshio Murakami, Kobe (JP); Katsura Kajihara, Kobe (JP); Tatsuya Asai, Kakogawa (JP); Naoki Mizuta, Kakogawa (JP); Hideo Hata, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 675 days.

(21) Appl. No.: 14/377,354

(22) PCT Filed: Feb. 6, 2013

(86) PCT No.: PCT/JP2013/052729

§ 371 (c)(1),
(2) Date: Aug. 7, 2014

(87) PCT Pub. No.: WO2013/129049

PCT Pub. Date: Sep. 6, 2013

(65) Prior Publication Data

US 2015/0000796 A1 Jan. 1, 2015

(30) Foreign Application Priority Data

Feb. 29, 2012 (JP) ..... 2012-044068

(51) Int. Cl.

| | |
|---|---|
| ***C22C 38/06*** | (2006.01) |
| ***C21D 8/00*** | (2006.01) |
| ***C21D 8/02*** | (2006.01) |
| ***C21D 9/46*** | (2006.01) |
| ***C22C 38/58*** | (2006.01) |
| ***C22C 38/00*** | (2006.01) |
| ***C22C 38/02*** | (2006.01) |
| ***C22C 38/04*** | (2006.01) |
| ***C22C 38/08*** | (2006.01) |
| ***C22C 38/12*** | (2006.01) |
| ***C22C 38/16*** | (2006.01) |
| ***C22C 38/18*** | (2006.01) |

(52) U.S. Cl.

CPC ..... *C21D 8/005* (2013.01); *C21D 8/02* (2013.01); *C21D 8/0236* (2013.01); *C21D 8/0247* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/18* (2013.01); *C22C 38/58* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C22C 38/04

See application file for complete search history.

(56) References Cited

U.S. PATENT DOCUMENTS

| | | | |
|---|---|---|---|
| 7,468,109 | B2 | 12/2008 | Kashima |
| 7,591,977 | B2 | 9/2009 | Ikeda et al. |
| 7,767,036 | B2 | 8/2010 | Kashima et al. |
| 7,887,648 | B2 | 2/2011 | Kinugasa et al. |
| 8,197,617 | B2 | 6/2012 | Nakaya et al. |
| 8,343,288 | B2 | 1/2013 | Murakami et al. |
| 8,597,439 | B2 | 12/2013 | Ikeda et al. |
| 8,673,093 | B2 | 3/2014 | Ikeda et al. |
| 8,679,265 | B2 | 3/2014 | Murakami et al. |
| 2005/0150580 | A1 | 7/2005 | Akamizu et al. |
| 2008/0251160 | A1 | 10/2008 | Akamizu et al. |
| 2009/0053096 | A1 | 2/2009 | Miura et al. |
| 2009/0242085 | A1 | 10/2009 | Ikeda et al. |
| 2009/0277547 | A1 | 11/2009 | Saito et al. |
| 2010/0221138 | A1 | 9/2010 | Nakaya et al. |

(Continued)

FOREIGN PATENT DOCUMENTS

| | | | |
|---|---|---|---|
| EP | 1 865 085 | A1 | 12/2007 |
| EP | 2 546 375 | A1 | 1/2013 |

(Continued)

OTHER PUBLICATIONS

Extended European Search Report dated Oct. 1, 2015 in European Patent Application No. 13755142.0.

(Continued)

*Primary Examiner* — Roy King

*Assistant Examiner* — Jophy S Koshy

(74) *Attorney, Agent, or Firm* — Oblon, McClelland, Maier & Neustadt, L.L.P.

(57) ABSTRACT

This high-strength steel sheet contains, in mass %, 0.05 to 0.3% of C, 1 to 3% of Si, 0.5 to 3% of Mn, up to 0.1% (inclusive of 0%) of P, up to 0.01% (inclusive of 0%) of S, 0.001 to 0.1% of Al and 0.002 to 0.03% of N with the balance consisting of iron and unavoidable impurities, and has a microstructure which comprises, in area fraction relative to the microstructure, 40 to 85% of bainitic ferrite, 5 to 20% of retained austenite ($\gamma_R$), 10 to 50% (in total) of martensite and $\gamma_R$, and 5 to 40% of ferrite. The retained austenite ($\gamma_R$) has a C concentration of 0.5 to 1.0 mass %, while the quantity of $\gamma_R$ present in the ferrite grains is 1% or more (in area fraction) relative to the microstructure.

16 Claims, 1 Drawing Sheet

(56) References Cited

U.S. PATENT DOCUMENTS

| | | | |
|---|---|---|---|
| 2012/0009434 | A1 | 1/2012 | Hata et al. |
| 2012/0012231 | A1 | 1/2012 | Murakami et al. |
| 2013/0022490 | A1 | 1/2013 | Hata et al. |
| 2013/0048161 | A1 | 2/2013 | Matsuda et al. |
| 2013/0236350 | A1 | 9/2013 | Kakiuchi et al. |
| 2013/0259734 | A1 | 10/2013 | Kakiuchi et al. |
| 2013/0330226 | A1 | 12/2013 | Murakami et al. |
| 2014/0096876 | A1 | 4/2014 | Matsuda et al. |

FOREIGN PATENT DOCUMENTS

| | | | |
|---|---|---|---|
| JP | 2003-113442 | | 4/2003 |
| JP | 2006-274418 | | 10/2006 |
| JP | 2007-321237 | | 12/2007 |
| JP | 4506476 | | 7/2010 |
| JP | 2011-184758 | A | 9/2011 |
| KR | 10-2007-0107179 | A | 11/2007 |
| WO | WO 2006/109489 | A1 | 10/2006 |
| WO | WO 2011/111333 | A1 | 9/2011 |
| WO | WO 2011/118597 | A1 | 9/2011 |

OTHER PUBLICATIONS

Cai-nian Jing, et al. "Research Progress of the Influencing Factors on Transformation Induced Plasticity" Heat Treatment of Metals, Feb. 2005, Feb. 30, 2005, pp. 26-31 (with English Abstract).

U.S. Appl. No. 14/238,599, filed Jun. 5, 2014, Murakami, et al.

International Search Report dated Apr. 23, 2013, in PCT/JP13/052729 filed Feb. 6, 2013.

Written Opinion of the International Searching Authority dated Apr. 23, 2013, in PCT/JP13/052729 filed Feb. 6, 2013.

(a) INVENTIVE STEEL (STEEL No. 2)
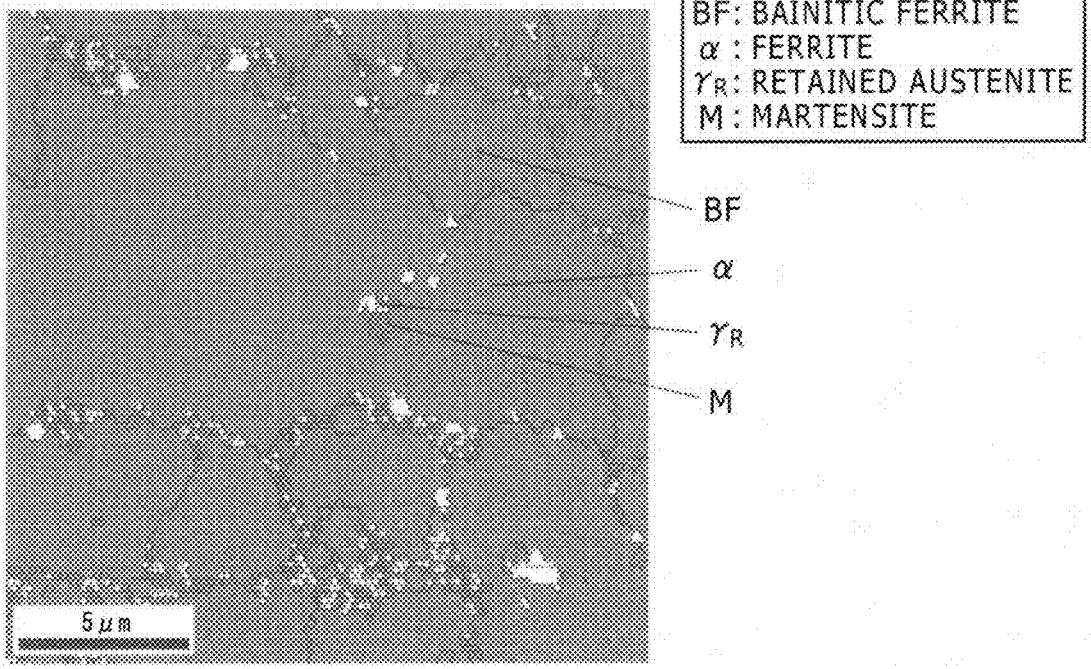
(b) COMPARATIVE STEEL (STEEL No. 5)
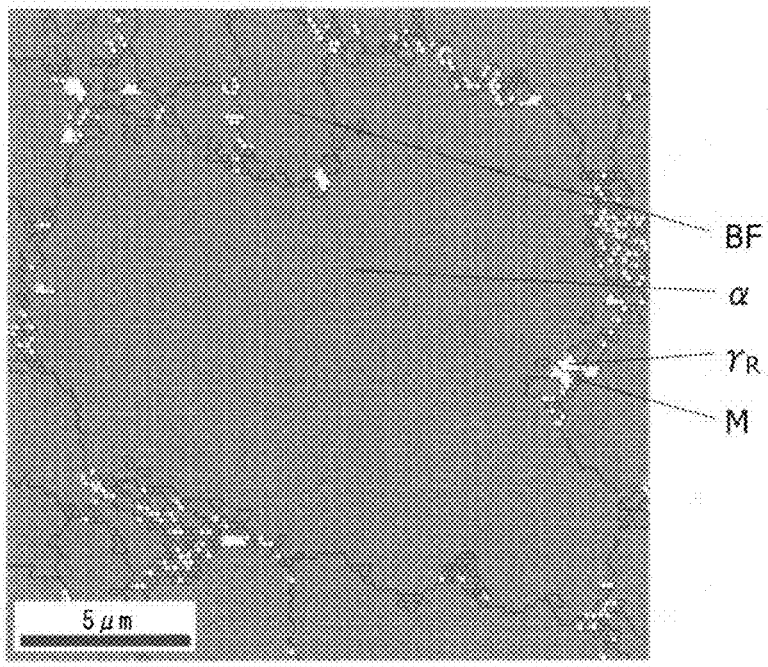

HIGH-STRENGTH STEEL SHEET WITH EXCELLENT WARM FORMABILITY AND PROCESS FOR MANUFACTURING SAME

TECHNICAL FIELD

The present invention relates to a high-strength steel sheet with excellent warm formability for use in car components, etc. and a process for manufacturing the same. The high-strength steel sheet of the present invention include cold rolled steel sheets, hot-dip galvanizing-coated steel sheets, and hot dip galvannealed steel sheets.

BACKGROUND ART

For thin steel sheets for use in framework components of cars, higher strength is required for attaining car crush safety and improvement of fuel cost. For this purpose, while it is demanded to increase the strength of a steel sheet to 980 MPa grade or more, since forming load increases during pressing, this involves a problem that an excessive load is applied to a press. Accordingly, it has been demanded for the development of a steel sheet having a low strength during forming and a high strength during use after the forming. Then, as means for reducing load during forming, warm forming has been known (for example, refer to patent literatures (PTL 1 and 2).

PTL 1 discloses a high-strength steel sheet for use in warm forming having a ratio of a tensile strength at 450° C. to a tensile strength at a room temperature of 0.7 or less. However, the high-strength steel sheet for use in warm forming less lowers a tensile strength at 150° C. (refer to paragraph [0056], Table 3) and has to be formed in a relatively high temperature region of from 350° C. to an $A_1$ point in order to obtain a sufficient effect of reducing the load during forming (refer to paragraph [0018]). Accordingly, the steel sheet involves a problem that the surface state of the steel sheet is impaired due to oxidation and consumption of energy for heating the steel sheet is increased. Further, it may be possible that the strength during use after the forming may be lowered due to annealing of martensite.

PTL 2 discloses a cold rolled steel sheet containing, on the basis of mass %, 0.040 to 0.20% of C, 1.5% or less of Si, 0.50 to 3.0% of Mn, 0.10% or less of P, 0.01% or less of S, 0.01 to 0.5% of Al, 0.005% or less of N, and 0.10 to 1.0% of V with the balance consisting of Fe and unavoidable impurities and which is further suitable to warm forming where 90% or more of V is in a solid solution state. However, the cold rolled sheet has to be worked in a relatively high temperature region of 300° C. or higher and an $A_1$ point or lower (refer to paragraph [0021]). Accordingly, the steel sheet involves a problem that the surface state of the steel sheet is impaired due to oxidation and consumption of energy for heating the steel sheet is increased in the same manner as the high tensile strength steel sheet for use in warm forming described in PTL 1. Further, since expensive V has to be added, it also involves a problem of increasing the cost.

CITATION LIST

Patent Literature

PTL 1: Japanese Unexamined Patent Application Publication No. 2003-113442

PTL 2: Japanese Patent Publication (JP-B) No. 4506476

SUMMARY OF INVENTION

Technical Problem

The present invention has been made taking notice on such circumstances, and an object thereof is to provide a high-strength steel sheet having a strength sufficiently lowered during warm forming in a temperature range (150 to 250° C.) which is lower than that in the prior art and, on the other hand, capable of ensuring high strength of 980 MPa or more during use at a room temperature after the forming, as well as a process for manufacturing the high-strength steel sheet.

Solution to Problem

The invention as disclosed in claim 1 provides a high-strength steel sheet with excellent warm formability having a chemical composition, on the basis of mass % (identical hereinafter for chemical components), including:

C: 0.05% to 0.3%,

Si: 1 to 3%,

Mn: 0.5% to 3%,

P: 0.1% or less (inclusive of 0%),

S: 0.01% or less (inclusive of 0%),

Al: 0.01% or less to 0.1% and

N: 0.02% to 0.03%, with the balance consisting of iron and impurities, and having a microstructure including:

bainitic.ferrite: 40 to 85%, retained austenite: 5 to 20%, martensite+the retained austenite: 10 to 50%, and ferrite: 5 to 40%, in terms of an area fraction relative to the total microstructure (hereinafter identical for microstructures), in which the retained austenite has a C concentration ($C\gamma_R$): 0.5 to 1.0 mass %, and the retained austenite in ferrite grains is present by 1% or more in terms of the area fraction relative to the total microstructure.

The invention as disclosed in claim 2 provides a high-strength steel sheet with excellent warm formability according to claim 1, in which the chemical composition further includes at least one of:

Cr: 0.01% to 3%,

Mo: 0.01 to 1%,

Cu: 0.01 to 2%,

Ni: 0.01 to 2%,

B: 0.00001 to 0.01%,

Ca: 0.0005 to 0.01%,

Mg: 0.0005 to 0.01%, and

REM: 0.0001 to 0.01%.

The invention as disclosed in claim 3 provides a method for manufacturing a high-strength cold rolled steel sheet with excellent warm formability, the method including hot rolling the steel sheet having the chemical composition shown in claim 1 or 2, cold rolling the same, and then applying a heat treatment under each of the following conditions (1) to (3):

(1) Hot rolling condition finish rolling end temperature: Ara point or higher coiling temperature: 450 to 750° C.

(2) Cold rolling condition cold rolling reduction: 20 to 80%

(3) Heat treatment condition

The steel sheet is subjected to temperature elevation in a temperature elevation pattern satisfying the following formula 1 in a temperature region of 600 to $Ac_1$° C., held at a annealing heating temperature of $(0.4\times Ac_1+0.6\times Ac_3)$ to $(0.05\times Ac_1+0.95\times Ac_3)$ for an annealing holding time of 1800s or less, then cooled rapidly at an average cooling rate of 5° C./s or more from the annealing heating temperature to an austempering temperature of 350 to 500° C., then held at the austempering temperature for an austempering holding time of 10 to 1800s, and then cooled to a room temperature, or held at the austempering temperature for the austempering holding time of 10 to 100s, then subjected again to temperature elevation to a reheating temperature of 480 to 600° C., then held at the reheating temperature for a reheating holding time of 1 to 100s and then cooled to a room temperature.

[Equation 1]

$$X=1-\exp\left(-\left(\int_{t_{600^\circ C}}^{t_{Ac1}}\left(\exp(0.8\ln(D_{Fe})+1.8\ln(\rho_o)-33.7)^{1/0.58}\cdot dt\right)^{0.58}\right)\right)\leq 0.5 \qquad \text{Formula 1:}$$

in which $$D_{Fe}=0.0118\cdot\exp\left(-\frac{281500}{8.314\cdot(T(t)+273)}\right)$$

$$\rho_o=1.54\times10^{15}\cdot\ln\left(-\ln\left(\frac{100-[CR]}{100}\right)\right)+2.51\times10^{15}$$

where

X: recrystallization ratio (−), $D_{Fe}$: iron self diffusibility ($m^2/s$), $\rho_0$: initial dislocation density ($m/m^3$), t: time(s), $t_{600^\circ C}$: time(s) till reaching 600° C., $t_{Ac1}$: time(s) till reaching an $Ac_1$ point, T(t): temperature (° C.) at time t,

[CR]: cold rolling reduction (%).

Advantageous Effects of Invention

According to the present invention, since the steel sheet has a microstructure including 40 to 85% of bainitic.ferrite, 5 to 20% of retained austenite, 10 to 50% of martensite+the retained austenite, and 5 to 40% of ferrite, in terms of the area fraction relative to the total microstructure, in which the retained austenite has 0.5 to 1.0 of mass % of C concentration ($C\gamma_R$) and the retained austenite is present in ferrite grains by 1% or more in terms of the area fraction relative to the total microstructure, the present invention can provide a high-strength steel sheet having a strength reduced sufficiently during warm forming at a temperature region (150 to 250° C.) which is lower than that of conventional steel sheet and, on the other hand, capable of ensuring a high strength of 980 MPa or more during use at a room temperature after the forming, as well as a production process therefor.

BRIEF DESCRIPTION OF DRAWINGS

FIG. 1 shows photographs of cross sectional microstructures of a steel sheet according to the present invention and a steel sheet according to the prior art.

DESCRIPTION OF EMBODIMENTS

For high-strength steel sheets with excellent formability, the present inventors have noted on TRIP steel sheets containing bainitic-ferrite having a submicrostructure of high dislocation density (matrix) and retained austenite ($\gamma_R$), and have investigated a method of sufficiently reducing the strength during warm forming in a temperature region (150 to 250° C.) which is lower than that in the prior art and ensuring a high strength of 980 MPa or more during use at a room temperature after the forming.

As a result, it has been found that a high-strength steel sheet capable of compatibilizing the warm formability in a temperature region lower than usual and ensuring of a room temperature strength by the following means (1) to (3).

(1) Ferrite and martensite are introduced partially into a microstructure, thereby optimizing a strength-ductility balance in the matrix.

(2) $\gamma_R$ at a carbon concentration of 0.5 to 1.0 mass % is contained by 5% or more in terms of the area fraction, thereby enhancing a room temperature strength due to the TRIP effect.

(3) In this case, 1% or more of $\gamma_R$ in terms of the area fraction is covered with ferrite (that is, 1% or more of the area fraction is ensured for $\gamma_R$ present in the ferrite grains), thereby tending to strain $\gamma_R$ during plastic working and promoting deformation-induced martensitic transformation at a room temperature to ensure a room temperature strength of 980 MPa or more in combination with the matrix. On the other hand, when the steel sheet is worked in a warm temperature region of 150° C. to 250° C., deformation-induced martensitic transformation of $\gamma_R$ is suppressed and the strength lowers to reduce the forming load. In this case, since contribution of the deformation-induced martensitic transformation of $\gamma_R$ to the room temperature strength is increased, the forming load is reduced greatly in the warm temperature region to result excellent warm formability.

Further, for ensuring the area fraction of $\gamma_R$ present in the ferrite grains, it has been found that promotion of nuclear formation of austenite in the ferrite grain during soaking in a ferrite-austenite dual phase temperature region is effective by suppressing recrystallization of cold-rolled ferrite during cold rolling in the course of temperature elevation in the annealing step.

Investigation has been proceeded further based on the findings described above to accomplish the present invention.

The microstructure characterizing the steel sheet according to the present invention is to be described.

[Microstructure of Steel Sheet of the Present Invention]

As has been described above, the steel sheet of the present invention is based on the microstructure of a TRIP steel and it is particularly characterized in that ferrite and martensite are contained each in a predetermined amount and $\gamma_R$ at a carbon concentration of 0.5 to 1.0 mass % is contained by 5 to 20% in terms of the area fraction and, further, 1% or more of $\gamma_R$ in terms of the area fraction is covered with ferrite (that is, present in the ferrite grain).

<Bainitic.ferrite: 40 to 85%>

"Bainitic.ferrite" in the present invention has a submicrostructure in which the bainite microstructure has a lathshaped microstructure with a high dislocation density and does not contain carbides in the microstructure and, in this regard, is distinctly different from the bainite microstructure, and also different from a polygonal ferrite microstructure having a submicrostructure with no or very little dislocation density and from a quasi-polygonal ferrite microstructure having a submicrostructure such as of fine sub-grains (refer to "Photographs for Bainite of Steel-1" issued by the Basic Research Group of the Iron and Steel Institute of Japan).

Since the microstructure of the steel sheet of the present invention has a bainitic.ferrite which is uniformly fine, excellent in ductility and has high dislocation density and high strength as a matrix, the strength-formability balance can be enhanced.

In the steel sheet of the present invention, the amount of the bainitic-ferrite microstructure should be 40 to 85% (preferably 40 to 75% and, more preferably, 40 to 65%) in terms of the area fraction) relative to the total microstructure. This is because the advantageous effect due to the bainitic-ferrite microstructure can be attained effectively. The amount of the bainitic-ferrite microstructure may be decided based on the balance with $\gamma_R$, and it is recommended to control the amount appropriately so as to allow the steel sheet to exhibit desired properties.

<Retained Austenite ($\gamma_R$): 5 to 20%>

$\gamma_R$ is useful for improving the total elongation. To exhibit the effect effectively, $\gamma_R$ should be present by 5% or more (preferably 7% or more, and more preferably, 10% or more) in terms of the area fraction relative to the total microstructure. In contrast, $\gamma_R$, if present in a large amount, may significantly impair the stretch flangeability and the upper limit is defined as 20%.

<Martensite+Retained Austenite ($\gamma_R$): 10 to 50%>

Martensite is introduced partially into the microstructure for ensuring the strength. Since the formability can be ensured no more if the amount of the martensite is larger, the amount of martensite+$\gamma_R$ relative to the total microstructure is restricted to 10% or more (preferably, 15% or more, and, more preferably, 20% or more) and 50% or less (preferably, 45% or less, and more preferably, 40% or less) in terms of the area fraction.

<Ferrite: 5 to 40%>

Since ferrite is a soft phase, it cannot be utilized by itself for increasing the strength but ferrite is effective for enhancing the ductility of the matrix. Further, since ferrite plastically deforms preferentially during forming, strains tend to be accumulated in the grains which contributes to securing of the room temperature strength by promoting the deformation-induced martensitic transformation of $\gamma_R$ present in the ferrite grains. Accordingly, ferrite is introduced in a range of 5% or more (preferably, 7% or more, and more preferably, 9% or more) and 40% or less (preferably, 35% or less and, more preferably, 30% or less) in terms of the area fraction.

<C Concentration ($C\gamma_R$) of Retained Austenite ($\gamma_R$): 0.5 to 1.0 mass %>

$C\gamma_R$ is an index effectuating the stability when $\gamma_R$ is transformed into martensite during working. If the amount of $C\gamma_R$ is insufficient, since stability is not sufficient during warm forming at 150 to 250° C. to cause deformation-induced martesitic transformation, this increases the load during warm forming. On the other hand, if $C\gamma_R$ is larger, it is stabilized excessively and does not cause sufficient deformation-induced martensitic transformation even when subjected to working at a room temperature, so that it is necessary to increase the strength of the matrix for ensuring the room temperature strength during warm forming. In order to lower the load during warm forming at 150 to 250° C., $C\gamma_R$ should be 0.5 to 1.0 mass % and, preferably, 0.7 to 0.9 mass %.

<$\gamma_R$ Present in Ferrite Grains: 1% or More>

When $\gamma_R$ is covered with soft ferrite, deformation-induced martensitic transformation of $\gamma_R$ is promoted to enhance the room temperature strength. Further, a significant effect of reducing the load can be obtained by suppressing the deformation-induced martensitic transformation of $\gamma_R$ during warm forming at 150 to 250° C. To effectively exhibit the effect, the amount of $\gamma_R$ present in the ferrite grains is 1% or more and, preferably, 1.1% or more in terms of the area fraction to the total microstructure.

<Others: Bainite (Inclusive of 0%)>

The steel sheet of the present invention may include the above-mentioned microstructure alone (mixed microstructure of martensite and/or bainitic.ferrite, polygonal ferrite, and $\gamma_R$), but may further include bainite as other dissimilar microstructure within a range not impairing the effect of the present invention. The bainite microstructure can inevitably remain during the process of producing the steel sheet of the present invention, but less bainite microstructure is more preferred and it is recommended to control the bainite to be 5% or less, and preferably 3% or less in terms of the area fraction relative to the total microstructure.

[Measurement Methods for Area Fraction of Respective Phases, C Concentration ($C\gamma_R$) in $\gamma_R$, and Area Fraction of $\gamma_R$ Present in Ferrite Grains]

Measurement methods for area fractions of respective phases, C concentration ($C\gamma_R$) in $\gamma_R$, and area fraction of $\gamma_R$ present in the ferrite grains will be described below.

The area fractions of the respective microstructures in the steel sheet were measured by subjecting the steel sheet to LePera etching and defining microstructures, for example, white regions as "martensite+retained austenite ($\gamma_R$) through observation with an optical microscope (at 1000-fold magnification).

The area fraction of $\gamma_R$ and the C concentration ($C\gamma_R$) of $\gamma_R$ were measured by grinding the steel sheet to ¼ sheet thickness, subjecting the ground steel sheet to chemical polishing, and measuring by X-ray diffractometry (ISIJ Int. Vol. 33 (1933), No. 7, p. 776). The area fraction of ferrite was determined by subjecting the steel sheet to nital etching and identifying lumpy white regions of a circle equivalent diameter of 5 μm or more as ferrite through observation with an optical microscope (at 400 fold magnification). Further, after identifying the area fraction of other microstructure such as bainite by a scanning electron microscope (at 5,000-fold magnification), other portions than "martensite+retained austenite ($\gamma_R$)", and "ferrite", and "other microstructure" described above were calculated as bainitic.ferrite Further, the area fraction of $\gamma_R$ present in ferrite grains was measured as follows. At first, EBSD measurement was performed at 0.2 μm pitch by using OIM™ manufactured by TSL Co. for a scanning type electron microscope (JSM-5410 manufactured by JEOL Co.) and mapping is carried out for grain boundaries at misorientation of 15° or more to adjacent crystal grains of FCC phage and BCC phase. In the mapping, a region mapped as the FCC phase is defined and identified as $\gamma_R$. A region of the BCC phase in which the area of the grain boundary at misorientation of 15° or more is less than 10 pixels and a region which could not be analyzed as the FCC phase or the BCC phase are defined and identified as martensite. For the remaining BCC phase, a region in which regions in continuous at misalignment of less than 15° are 490 or more pixels (circle equivalent diameter of 5 μm or more) is defined and determined as ferrite, and the remaining regions are defined and determined as bainitic-ferrite respectively. A grain boundary surrounding a region in which regions in continuous at misorientation of less than 15° are 490 or more pixels is defined as a ferrite grain boundary, and $\gamma_R$ not in contact with the ferrite grain boundary and bainitic.ferrite is defined as $\gamma_R$ present in the ferrite grains. Since $\gamma_R$ is often present while forming a mixed microstructure with martensite, criteria for judging the presence region of $\gamma_R$ are applied on the basis of the mixed microstructure unit.

In view of the restriction of the resolution power in the EBSD measurement, fine $\gamma_R$ (FCC phase) is not tended to be mapped and the $\gamma_R$ area fraction obtained by the mapping in the EBSD measurement is less than the area fraction of $\gamma_R$ obtained by X-ray diffraction. Accordingly, the ratio of $\gamma_R$ present in the ferrite grains to the entire $\gamma_R$ in the mapping is calculated, and the area fraction of $\gamma_R$ present in the ferrite grains was determined by calculating the rate of $\gamma_R$ present in the ferrite grains in the entire $\gamma_R$ during mapping and multiplying the ratio to the $\gamma_R$ area fraction obtained by X-ray diffraction.

Next, the chemical composition constituting the steel sheet of the present invention will be described. Hereinafter, all chemical compositions are based on mass %.

[Chemical Composition of Steel Sheet of the Present Invention] C: 0.05 to 0.3%

C is an essential element for obtaining desired principal microstructures (bainitic.ferrite+martensite+$\gamma_R$) while ensuring high strength. To provide the effect effectively, C should be added by 0.05% or more (preferably 0.10% or more, and more preferably 0.15% or more). However, a steel sheet with more than 0.3% of C may be unsuitable for welding.

Si: 1 to 3%

Si is an element effectively suppressing the decomposition of $\gamma_R$ to form carbides. Si is particularly useful also as a solid-solution strengthening element. To exhibit the effect effectively, Si should be added by 1.0% or more. The amount is preferably 1.1% or more, and more preferably 1.2% or more. However, Si, if added by more than 3%, may impede the formation of the bainitic.ferrite+martensite microstructure and increase hot deformation resistance to often embrittle weld beads, and impair the surface quality of the steel sheet. Accordingly, the upper limit of Si is set to 3%, preferably 2.5% or less, and more preferably 2% or less.

Mn: 0.5 to 3%

Mn effectively acts as a solid-solution strengthening element and also exhibits the effect of promoting transformation to thereby accelerate the formation of the bainitic.ferrite+martensite microstructure. In addition, Mn is an element necessary for stabilizing ($\gamma$) to thereby obtain desired $\gamma_R$. To exhibit the effects effectively, Mn should be added by 0.5% or more, preferably, 0.7% or more, and more preferably 1% or more. However, Mn, if added by more than 3%, may cause adverse effects such as cracking of slab. Mn is preferably 2.5% or less, and more preferably 2% or less.

P: 0.1% or Less (Inclusive of 0%)

While P is an element present inevitably as an impurity element, P may be added for ensuring desired $\gamma_R$. However, P, if added by more than 0.1%, may deteriorate secondary formability. P is preferably 0.03% or less.

S: 0.01% or Less (Inclusive of 0%)

S is an element which is also present inevitably as an impurity element and forms sulfide inclusions such as MnS, to thereby trigger cracking and impair the formability. S is preferably 0.008% or less and, more preferably, 0.005% or less.

Al: 0.001 to 0.1%

Al is added as a deoxidizing agent. However, if Al is added excessively, the effect is saturated and economically inefficient, so that the upper limit is 0.1%.

N: 0.002 to 0.03%

N is an element present inevitably. Since decrease of N to less than 0.002% may remarkably increase production load, the lower limit is 0.002%. On the other hand, if N is excessive, since casting becomes difficult for low carbon steels as in the material of the invention, production per se is impossible.

The steel for use in the present invention basically contains the components described above, with the balance substantially consisting of iron and unavoidable impurities. The steel may further contain the following permissible component, within ranges not impairing the effect of the present invention.

One or more of the following elements:

Cr: 0.01 to 3%,

Mo: 0.01 to 1%,

Cu: 0.01 to 2%,

Ni: 0.01 to 2%,

B: 0.00001 to 0.01%

These elements are useful as strengthening elements for the steel and are also effective for ensuring $\gamma_R$ by a predetermined amount. To exhibit the effects effectively, it is recommended to add 0.01% or more (preferably 0.02% or more) of Cr, 0.01% or more (preferably 0.02% or more) of Mo, 0.01% or more (preferably 0.1% or more) of Cu, 0.01% or more (preferably 0.1% or more) of Ni, and 0.00001% or more (preferably 0.0002 or more) of B, respectively. However, if Cr is added by more than 3%, Mo is added by more than 1%, Cu and Ni are added by more than 2% respectively, and B is added by more than 0.01%, the effects are saturated and economically inefficient. More preferably Cr is 2.0% or less, Mo is 0.8% or less, Cu is 1.0% or less, Ni is 1.0% or less, and B is 0.0030% or less.

One or more of the following elements:

Ca: 0.0005 to 0.01%,

Mg: 0.0005 to 0.01%,

REM: 0.0001 to 0.01%

The elements are effective for controlling the form of sulfides in the steel and improving the formability. REM (rare-earth elements) for use in the present invention include Sc, Y, and lanthanoids. To exhibit the effect effectively, it is recommended to add Ca and Mg each by 0.0005% or more (more preferably 0.001% or more) and REM by 0.0001% or more (more preferably 0.0002% or more). However, if the elements are added each by more than 0.01%, the effect may be saturated and economically inefficient. More preferably, Ca and Mg are added each by 0.003% or less and REM is added by 0.006% or less.

Next, a preferred method for producing the steel sheet of the present invention is to be explained below.

[Preferred Method for Producing Steel Sheet of the Present Invention]

The steel sheet of the present invention is manufactured by hot rolling, cold rolling, and then heat treating a steel sheet that satisfies the chemical composition described above under each of the following conditions (1) to (3), in which nuclear formation of austenite in ferrite grains is promoted in a ferrite.austenite dual phase temperature region by suppressing recrystallization of cold-rolled ferrite so that $\gamma_R$ is present in the ferrite grains by 1% or more in terms of the area fraction.

(1) Hot Rolling Condition

Finish rolling end temperature: $Ar_3$ point or higher

Coiling temperature: 450 to 700° C.

Usual conditions may be adopted such that hot rolling finish temperature (finish rolling end temperature, FDT) is $Ar_3$ point or higher and the coiling temperature is 450 to 700° C.

(2) Cold Rolling Condition

Cold rolling reduction: 20 to 80%

Further, formation of austenite in the ferrite grains is promoted during soaking in the succeeding annealing step by straining the ferrite by controlling the cold rolling reduction (cold rolling reduction) upon cold rolling to 20 to 80%.

(3) Heat Treatment Condition

A steel sheet is subjected to temperature elevation in a temperature elevation pattern satisfying the following formula 1 in a temperature region of 600 to $Ac_1$° C., held at an annealing heating temperature of $(0.4\times Ac_1+0.6\times Ac_3)$ to $(0.05\times Ac_1+0.95\times Ac_3)$ for an annealing holding time of 1800s or less, then cooled rapidly at an average cooling rate of 5° C./s or more from the annealing heating temperature to an austempering temperature of 350 to 500° C., then held at the austempering temperature for an austempering holding time of 10 to 1800s, and then cooled to a room temperature, or held at the austempering temperature for the austempering holding time of 10 to 100s, then subjected again to temperature elevation to a reheating temperature of 480 to 600° C., held at the reheating temperature for a reheating holding time of 1 to 100s, and then cooled to a room temperature.

[Equation 2]

$$X=1-\exp\left(-\left(\int_{t_{600^\circ C}}^{t_{Ac1}}\left(\exp(0.8\ln(D_{Fe})+1.8\ln(\rho_0)-33.7)^{0.58}\cdot dt\right)^{0.58}\right)\right)\leq 0.5 \qquad \text{Formula 1:}$$

in which $$D_{Fe}=0.0118\cdot\exp\left(-\frac{281500}{8.314\cdot(T(t)+273)}\right)$$

$$\rho_o=1.54\times10^{15}\cdot\ln\left(-\ln\left(\frac{100-[CR]}{100}\right)\right)+2.51\times10^{15}$$

where

X: recrystallization ratio (–), $D_{Fe}$: iron self diffusibility ($m^2/s$), $\rho_0$: initial dislocation density ($m/m^3$), t: time(s), $t_{600^\circ C}$: time(s) till reaching 600° C., $t_{Ac1}$: time(s) till reaching $Ac_1$ point, T(t): temperature (° C.) at time t,

[CR]: cold rolling reduction (%).

A desired microstructure can be obtained by performing rapid temperature elevation not known in the prior art for suppressing recrystallization of the ferrite during temperature elevation in the annealing step, then soaking the steel sheet in a (γ+α) dual phase temperature region for austenization, super cooling by quenching at a predetermined cooling rate, and applying austempering while holding the steel sheet for a predetermined time at a super cooling temperature. Plating and, further, an alloying treatment may also be applied within a range not remarkably decomposing the desired microstructure and not impairing the effect of the present invention.

The heat treatment conditions described above are to be described more specifically.

<Temperature Elevation in a Temperature Elevation Pattern Satisfying the Formula 1 in a Temperature Region of 600 to $Ac_1$° C.>

This is applied for suppressing recrystallization of ferrite by rapidly heating the steel sheet not known in the prior art during temperature elevation in the annealing step. This can promote the formation of the austenite in the ferrite grains in the succeeding soaking step.

A portion of "X=1−exp (---)" in the formula 1 is a prediction formula for the recrystallization ratio X of the ferrite and the derivation process is shown below.

That is, it has been found that the recrystallization ratio X can be represented by the following formula 1' as a result of the study on the effect of the recrystallization temperature and the holding time (t) by using the material in which the initial dislocation density po was changed by changing the cold rolling reduction.

$$X=1-\exp[-\exp\{A_1\ln(D_{Fe})+A_2\ln(\rho_0)-A_3\}\cdot t^n] \qquad \text{Formula 1':}$$

(in which $A_1$, $A_2$, $A_3$, n are constants).

For the self diffusion rate $D_{Fe}$ of iron, it has been known that the relation of formula 2 is established:

$$D_{Fe}=0.0118\exp[-281500/\{R(T+273)\}](m^2/s) \qquad \text{Formula 2:}$$

(where T: temperature (° C.), R: gas constant {=8.314 kJ/(K·kg-atom)}) (for example, refer to Iron and Steel Manual edited by the Iron and Steel Institute of Japan, Third Print, 1 Foundation, Maruzen 1981, p. 349).

Further, it was found that the initial dislocation density $\rho_0$ can be represented by the following formula 3 as a result of investigation on the correlationship between the initial dislocation density $\rho_0$ and the cold rolling reduction [CR] by using steel sheets obtained by applying cold rolling to various steel materials at a cold rolling reduction of 20 to 80%. The dislocation density was measured by using a method disclosed in Japanese Unexampled Patent Application Publication No. 2008-144233.

$$\rho_0=B_1 In[(-In\{(100-[CR])/100\}]+B_2 \qquad \text{Formula 3:}$$

(in which $B_1$ and $B_2$ are constants).

As a result of determining the values for the constants $B_1$ and $B_2$ in the formula 3 based on the result of the investigation, $B_1=1.54\times10^{15}$ and $B_2=2.51\times10^{15}$ were obtained within a range of the cold rolling reduction [CR] of 20 to 80%.

Then, for determining the values of the constants $A_1$, $A_2$, $A_3$, and n in the formula 1', the following test was performed.

Two types of materials were used for the test, that is, steel sheets cold rolled in an actual machine containing 0.17% of C, 1.35% of Si, and 2.0% of Mn which are within the range of the chemical composition of the present invention and which are as cold rolled at cold rolling reduction of 36% (before annealing.tempering treatment) (1.6 mm thickness) and cold rolled steel sheet formed by cold rolling the cold rolled steel sheet (cold-rolled by the actual machine) at cold rolling reduction of 36% further to a cold rolling reduction of 60%.

The two types of the cold rolled steel sheets were heat treated in a heat pattern of "rapid heating+holding for a predetermined time at a predetermined temperature+rapid cooling" under the combination of various holding temperatures and holding times, and hardness of the steel sheets before and after the heat treatment were measured respectively, and a crystallization ratio was calculated according to the definition formula of:

Recrystallization ratio=(hardness before heat treatment−hardness after heat treatment)/(hardness before heat treatment−180 Hv), since it is considered that the change of the hardness and the recrystallization ratio are in an intense correlationship. 180 Hv in the definition formula is the lowest hardness that the steel sheet is softened no more when the heat treatment is applied by extending the holding time successively in a state where the holding temperature is highest, which corresponds to the hardness in a state where recrystallization is completed by sufficient annealing and the steel sheet is completely softened.

As a result of determining the values for the constants $A_1$, $A_2$, $A_3$ and n in the formula 1' by Avrami plotting of the data for recrystallization ratio X calculated as described above as a relation between the holding temperature T and the holding time t, $A_1$=0.8. $A_2$=1.8, $A_3$=33.7, and n=0.58 were obtained.

Since the formula 1' is a formula for the case where T is constant, the formula 1' is changed to that of temperature T (t) as a function of the time t and deformed to a form of integration for a staying time between 600 to $Ac_1$° C., thereby deriving the portion of "X=1−exp (----)" in the formula 1.

For the steel sheets heat treated under various annealing conditions, when the recrystallization ratio X calculated by using a portion of: "X=1−exp (---)" in the formula 1 derived as described above is compared with a recrystallized state confirmed by microstructure observation of steel sheets after the actual heat treatment, since they agreed favorably, it could be confirmed that the prediction accuracy for the recrystallization ratio X according to the portion of; "X=1−exp (---)" in the formula 1 is sufficiently high.

Accordingly, "X=---≤0.5" in the formula 1 means that a temperature elevation pattern in the temperature region of 600 to $Ac_1$° C. is defined such that the recrystallization ratio of the ferrite is suppressed to 50% or less during temperature elevation in the succeeding annealing step after cold rolling at a cold rolling reduction CR. It is preferably X≤0.45, and more preferably X≤0.4.

<Annealing Heating Temperature: $(0.4\times Ac_1+0.6\times Ac_3)$ to $(0.05\times Ac_1+0.95\times Ac_3)$>

This is applied in order to form austenite in the ferrite grains by soaking in a (γ+α) dual phase temperature region and allow $\gamma_R$ to be present in the ferrite grains in the final microstructure. Further, by controlling the ferrite proportion within a desired range thereby lowering the matrix strength while ensuring a room temperature strength, the steel sheet can be formed under a low load during warm forming at 150 to 250° C. If the temperature is lower than $(0.4\times Ac_1+0.6\times Ac_3)$, the ferrite proportion increases excessively failing to obtain a desired room temperature strength. On the other hand, if the temperature is higher than $(0.05\times Ac_1+0.95\times Ac_3)$, the ferrite proportion decreases excessively and no sufficient amount of $\gamma_R$ can be present in the ferrite grains and, in addition, the strength of the matrix increases excessively to increase the load during warm forming. The temperature is preferably $(0.4\times Ac_1+0.6\times Ac_3)$ to $(0.1\times Ac_1+0.9\times Ac_3)$.

<Annealing Holding Time: 1800s or Less>

This is defined so as not to impair the productivity.

<Average Cooling Rate from Annealing Heating Temperature to Austempering Temperature: 5° C./s or Higher>

If the average cooling rate is less than 5° C./s, the ferrite proportion increases excessively failing to ensure the room temperature strength. This is preferably 8° C./s or higher and, more preferably, 10° C./s or higher.

<Austempering Temperature: 350 to 500° C.>

By applying an austempering treatment in a temperature region of 350 to 500° C., the bainite transformation in the austempering treatment is controlled to an optimal state thereby controlling the carbon concentration in the not-transformed austenite at an appropriate level. If the temperature is lower than 350° C., concentration of carbon to the not-transformed austenite is promoted excessively and the carbon concentration in $\gamma_R$ in the final microstructure increases excessively. On the other hand, if the temperature exceeds 500° C., bainite transformation does not proceed sufficiently to lower the $\gamma_R$ proportion in the final microstructure. The temperature is preferably 360 to 480° C. and, more preferably, 380 to 460° C.

<Austempering Holding Time: Holding for 10 to 1800s and then Cooling to Room Temperature>

This is determined assuming a case of producing a cold rolled steel sheet in a continuous annealing line (CAL) or in a case of producing a hot-dip galvanizing-coated steel sheet (GI steel sheet) in a hot dip galvanizing line. By applying an austempering treatment while holding for 10 to 1800s, the bainite transformation during the austempering treatment is controlled to an appropriate stage to control carbon concentration in the not-transformed austenite to an appropriate level. If the time is less than 10s, bainite transformation does not proceed sufficiently to lower the yR percentage in the final microstructure. On the other hand, if the time exceeds 1800s, cementite is precipitated from the not-transformed austenite failing to obtain a desired $\gamma_R$ proportion after cooling. The holding time is 100 to 1800s (preferably 200 to 800s) in a case of production in CAL and 10 to 100s (preferably 20 to 60s) is a case of producing the GI steel sheet.

<Alternatively, after Holding for Austempering Holding Time of 10 to 100s and Holding for Subsequent Reheating Holding Time of 1 to 100s at Reheating Temperature: 480-600° C., Cooling to a Room Temperature>

This is defined assuming a case of producing a hot-dip galvannealed steel sheet (GA steel sheet) in a hot dip galvanizing line. Reheating after the austempering treatment is for the alloying treatment. By applying an austempering treatment while holding for 10 to 100s (preferably 20 to 60s), bainite transformation during the austempering treatment is controlled to an appropriate stage thereby controlling the carbon concentration in the not-transformed austenite to an appropriate level. If the time is less than 10s, bainite transformation does not proceed sufficiently to lower the $\gamma_R$ proportion in the final microstructure. Reheating after the austempering treatment is applied for the alloying treatment. A preferred reheating temperature is 480 to 550° C.

Example

For confirming the applicability of the present invention, tensile strength of high-strength steel sheets at room temperature and warm forming and the effects thereof were investigated while changing the chemical compositions and production conditions variously. Test steels comprising various chemical compositions shown in Table 1 were vacuum-melted into slabs of 30 mm thickness, the slabs were heated to 1200° C., hot rolled at a finish rolling end temperature (FDT) of 900° C. into 2.5 mm thickness, then placed in a holding furnace at a coiling temperature of 500° C., and air cooled to simulate coiling of the hot rolled sheets. Subsequently, steel sheets were cold rolled at a cold rolling reduction of 52% into cold rolled sheets of 1.2 mm thickness. Then, the cold rolled sheets were heated at an average heating rate HR of 1° C./s from 600° C. to $Ac_1$ to a soaking temperature (annealing heating temperature) T1° C. so as to provide a recrystallization ratio X under each of the conditions shown in Table 2, held at the soaking temperature of T1° C. for t1 second and then, cooled at an average cooling rate CR of 1° C./s, held at a super cooling temperature (austempering temperature) T2° C. for t2 second, and then cooled, or held at a super cooling temperature of T2° C. for t2 second, then held further at a reheating temperature of T3° C. for t3 second, and then air cooled.

For each of the steel sheets obtained as described above, the area fraction for each of the phases, C concentration of $\gamma_R$ ($C\gamma_R$), and the area fraction of $\gamma_R$ present in the ferrite grains were measured by the measuring methods as explained in the paragraph of [Description of Embodiments].

For evaluating the room temperature strength and the warm forming strength in a temperature region lower than that of usual case for each of the steel sheets, JIS No. 5 test specimens were used and a tensile strength (TS) was measured by a tensile test at a strain rate of 1 mm/s each at room temperature and at 200° C. respectively. Then, difference ΔTS between the room temperature TS and the warm forming TS was calculated as an index for evaluating the effect of lowering the strength during warm forming.

The results are shown in Table 3 and Table 4.

TABLE 1

| Steel grade symbol | Component (mass %) C | Si | Mn | P | S | Al | N | Others | Transformation temperature (° C.) $Ac_1$ | $Ac_3$ | $0.4Ac_1 + 0.6Ac_3$ | $0.05Ac_1 + 0.95Ac_3$ |
|---|---|---|---|---|---|---|---|---|---|---|---|---|
| A | 0.18 | 1.50 | 2.00 | 0.01 | 0.001 | 0.040 | 0.0040 | — | 745 | 854 | 810 | 848 |
| B | 0.18 | 1.50 | 2.00 | 0.01 | 0.001 | 0.040 | 0.0040 | Ca: 0.001 | 745 | 854 | 810 | 848 |
| C | 0.18 | 1.50 | 2.00 | 0.01 | 0.001 | 0.040 | 0.0040 | Mg: 0.001 | 745 | 854 | 810 | 848 |
| Da | 0.03a | 1.50 | 2.50 | 0.01 | 0.001 | 0.040 | 0.0040 | Ca: 0.001 | 740 | 890 | 830 | 882 |
| E | 0.12 | 1.50 | 2.30 | 0.01 | 0.001 | 0.040 | 0.0040 | Ca: 0.001 | 742 | 861 | 813 | 855 |
| F | 0.23 | 1.50 | 1.80 | 0.01 | 0.001 | 0.040 | 0.0040 | Ca: 0.001 | 747 | 849 | 808 | 844 |
| Ga | 0.18 | 0.30a | 2.00 | 0.01 | 0.001 | 0.040 | 0.0040 | Ca: 0.001 | 710 | 800 | 764 | 796 |
| Ha | 0.18 | 4.00a | 2.00 | 0.01 | 0.001 | 0.040 | 0.0040 | Ca: 0.001 | 818 | 966 | 907 | 958 |
| Ia | 0.18 | 1.50 | 0.40a | 0.01 | 0.001 | 0.040 | 0.0040 | Ca: 0.001 | 762 | 902 | 846 | 895 |
| Ja | 0.18 | 1.50 | 4.00a | 0.01 | 0.001 | 0.040 | 0.0040 | Ca: 0.001 | 724 | 794 | 766 | 790 |
| K | 0.18 | 1.50 | 2.00 | 0.01 | 0.001 | 0.040 | 0.0040 | Cr: 0.15, Ca: 0.001 | 748 | 852 | 810 | 847 |
| L | 0.18 | 1.50 | 2.00 | 0.01 | 0.001 | 0.040 | 0.0040 | Mo: 0.2, Ca: 0.001 | 745 | 860 | 814 | 854 |
| M | 0.18 | 1.50 | 2.00 | 0.01 | 0.001 | 0.040 | 0.0040 | Cu: 0.5, Ca: 0.001 | 745 | 844 | 804 | 839 |
| N | 0.18 | 1.50 | 2.00 | 0.01 | 0.001 | 0.040 | 0.0040 | Ni: 0.4, Ca: 0.001 | 738 | 848 | 804 | 842 |
| O | 0.18 | 1.50 | 2.00 | 0.01 | 0.001 | 0.040 | 0.0040 | B: 0.0005, Ca: 0.010 | 745 | 854 | 810 | 848 |
| P | 0.18 | 1.50 | 2.00 | 0.01 | 0.001 | 0.040 | 0.0040 | REM: 0.001 | 745 | 854 | 810 | 848 |
| Q | 0.15 | 2.00 | 2.40 | 0.01 | 0.001 | 0.040 | 0.0040 | Ca: 0.001 | 756 | 872 | 825 | 866 |

(Index a: out of the range of the present invention)

TABLE 2

| Heat treatment No. | Steel grade symbol | 600° C. to $Ac_1$ heating rate HR1 (° C./s) | Recrystallization ratio X (—) | Soaking temperature T1 (° C.) | Holding time t1 (sec) | Cooling rate CR1 (° C./s) | Super cooling temperature T2 (° C.) | Holding time t2 (s) | Reheating temperature T3 (° C.) | Holding time t3 (s) |
|---|---|---|---|---|---|---|---|---|---|---|
| 1 | A | 40 | 0.35 | 820 | 90 | 40 | 440 | 45 | 510 | 10 |
| 2 | B | 40 | 0.35 | 820 | 90 | 40 | 440 | 45 | 510 | 10 |
| 3 | B | 80 | 0.26 | 820 | 90 | 40 | 440 | 45 | 510 | 10 |
| 4a | B | 15 | 0.56a | 820 | 90 | 40 | 440 | 45 | 510 | 10 |
| 5a | B | 8 | 0.69a | 820 | 90 | 40 | 440 | 45 | 510 | 10 |
| 6a | B | 40 | 0.35 | 780b | 90 | 40 | 440 | 45 | 510 | 10 |
| 7 | B | 40 | 0.35 | 840 | 90 | 40 | 440 | 45 | 510 | 10 |
| 8a | B | 40 | 0.35 | 860b | 90 | 40 | 440 | 45 | 510 | 10 |
| 9a | B | 40 | 0.35 | 820 | 90 | 2.5a | 440 | 45 | 510 | 10 |
| 10a | B | 40 | 0.35 | 820 | 90 | 40 | 320a | 45 | 510 | 10 |
| 11a | B | 40 | 0.35 | 820 | 90 | 40 | 510a | 45 | 510 | 10 |
| 12a | B | 40 | 0.35 | 820 | 90 | 40 | 440 | 5a | 510 | 10 |
| 13a | B | 40 | 0.35 | 820 | 90 | 40 | 440 | 45 | 620a | 10 |
| 14a | B | 40 | 0.35 | 820 | 90 | 40 | 440 | 45 | 510 | 150a |
| 15 | B | 40 | 0.35 | 820 | 90 | 40 | 440 | 360 | — | — |
| 16 | B | 40 | 0.35 | 820 | 90 | 40 | 440 | 45 | — | — |
| 17 | C | 40 | 0.35 | 820 | 90 | 40 | 440 | 45 | 510 | 10 |
| 18 | Da | 40 | 0.33 | 850 | 90 | 40 | 400 | 45 | 510 | 10 |
| 19 | E | 40 | 0.34 | 830 | 90 | 40 | 420 | 45 | 510 | 10 |
| 20 | F | 40 | 0.38 | 820 | 90 | 40 | 440 | 45 | 510 | 10 |
| 21 | Ga | 40 | 0.16 | 780 | 90 | 40 | 440 | 45 | 510 | 10 |
| 22a | Ha | 80 | 0.86a | 920 | 90 | 40 | 440 | 45 | 510 | 10 |
| 23 | Ia | 80 | 0.38 | 860 | 90 | 40 | 440 | 45 | 510 | 10 |
| 24 | Ja | 40 | 0.16 | 775 | 90 | 40 | 440 | 45 | 510 | 10 |
| 25 | K | 40 | 0.39 | 820 | 90 | 40 | 440 | 45 | 510 | 10 |
| 26 | L | 40 | 0.35 | 830 | 90 | 40 | 440 | 45 | 510 | 10 |

TABLE 2-continued

| Heat treatment No. | Steel grade symbol | 600° C. to $Ac_1$ heating rate HR1 (° C./s) | Recrystallization ratio X (—) | Soaking temperature T1 (° C.) | Holding time t1 (sec) | Cooling rate CR1 (° C./s) | Super cooling temperature T2 (° C.) | Holding time t2 (s) | Reheating temperature T3 (° C.) | Holding time t3 (s) |
|---|---|---|---|---|---|---|---|---|---|---|
| 28 | M | 40 | 0.35 | 820 | 90 | 40 | 440 | 45 | 510 | 10 |
| 29 | N | 40 | 0.31 | 820 | 90 | 40 | 440 | 45 | 510 | 10 |
| 30 | O | 40 | 0.35 | 830 | 90 | 40 | 440 | 45 | 510 | 10 |
| 31 | P | 40 | 0.35 | 830 | 90 | 40 | 440 | 45 | 510 | 10 |

(Index a: out of the range of the present invention)

TABLE 3

| | | | Microstructure | | | | | | | Mechanical properties | | | | |
|---|---|---|---|---|---|---|---|---|---|---|---|---|---|---|
| | | | Area fraction (%) | | | | | | | Room Temperature | Warm forming | | | |
| Steel No. | Steel grade symbol | Heat treatment No. | BF | α | M + $\gamma_R$ | $\gamma_R$ | $\gamma_R$ in α grains | Others | $C\gamma_R$ (mass %) | TS (MPa) | Temperature (° C.) | TS (MPa) | ΔTS (MPa) | Evaluation |
| 1 | A | 1 | 47 | 25 | 28 | 12.5 | 1.2 | 0 | 0.86 | 1005 | 200 | 745 | 260 | ○ |
| 2 | B | 2 | 44 | 26 | 30 | 12.8 | 1.3 | 0 | 0.85 | 1020 | 200 | 755 | 265 | ○ |
| 3 | B | 3 | 46 | 25 | 29 | 13.0 | 2.0 | 0 | 0.85 | 1024 | 200 | 736 | 288 | ○ |
| 4 | B | 4a | 43 | 29 | 28 | 12.5 | 0.2a | 0 | 0.89 | 968b | 200 | 802b | 166 | X |
| 5 | B | 5a | 44 | 30 | 26 | 12.5 | 0.2a | 0 | 0.91 | 960b | 200 | 810b | 150 | X |
| 6 | B | 6a | 20a | 55a | 25 | 8.0 | 1.0 | 0 | 0.80 | 955b | 200 | 807b | 148 | X |
| 7 | B | 7 | 62 | 10 | 28 | 12.0 | 1.1 | 0 | 0.88 | 1030 | 200 | 778 | 252 | ○ |
| 8 | B | 8a | 70 | 0a | 30 | 10.5 | 0.0a | 0 | 0.98 | 1053 | 200 | 903b | 150 | X |
| 9 | B | 9a | 27a | 50a | 23 | 8.8 | 1.2 | 0 | 0.81 | 960b | 200 | 811b | 149 | X |
| 10 | B | 10a | 29a | 26 | 45 | 7.8 | 0.7a | 0 | 1.20a | 1190 | 200 | 1075b | 115 | X |
| 11 | B | 11a | 33a | 25 | 42 | 7.6 | 0.6a | 0 | 0.80 | 1145 | 200 | 1022b | 123 | X |
| 12 | B | 12a | 35a | 25 | 40 | 6.0 | 0.5a | 0 | 0.80 | 1185 | 200 | 1071b | 114 | X |
| 13 | B | 13a | 47 | 27 | 25 | 0.0a | 0.0a | 1 | 0.00a | 855b | 200 | 825b | 30 | X |
| 14 | B | 14a | 45 | 27 | 27 | 3.5a | 0.2a | 1 | 0.85 | 897b | 200 | 808b | 89 | X |
| 15 | B | 15 | 48 | 25 | 27 | 14.9 | 1.4 | 0 | 0.88 | 982 | 200 | 683 | 299 | ○ |
| 16 | B | 16 | 48 | 24 | 28 | 12.7 | 1.3 | 0 | 0.85 | 1015 | 200 | 752 | 263 | ○ |

(Index a: out of the range of the present invention, Index b: out of the recommended range BF: bainitic ferrite, α: ferrite, M: martensite, $\gamma_R$: retained austenite, ΔTS = room temperature TS − warm forming TS ○: [room temperature TS ≥980 MPa] and [warm forming TS ≤780 MPa], X: not satisfying the conditions "○")

TABLE 4

(continued from Table 3)

| | | | Microstructure | | | | | | | Mechanical properties | | | | |
|---|---|---|---|---|---|---|---|---|---|---|---|---|---|---|
| | | | Area fraction (%) | | | | | | | Room Temperature | Warm forming | | | |
| Steel No. | Steel grade symbol | Heat treatment No. | BF | α | M + $\gamma_R$ | $\gamma_R$ | $\gamma_R$ in α grains | Others | $C\gamma_R$ (mass %) | TS (MPa) | Temperature (° C.) | TS (MPa) | ΔTS (MPa) | Evaluation |
| 17 | C | 17 | 46 | 25 | 29 | 12.6 | 1.2 | 0 | 0.84 | 1019 | 200 | 766 | 253 | ○ |
| 18 | Da | 18 | 60 | 30 | 10 | 0.3a | 0.0a | 0 | 0.80 | 980 | 200 | 940b | 40 | X |
| 19 | E | 19 | 50 | 25 | 25 | 11.0 | 1.0 | 0 | 0.80 | 990 | 200 | 740 | 250 | ○ |
| 20 | F | 20 | 44 | 26 | 30 | 13.0 | 1.3 | 0 | 0.85 | 1023 | 200 | 733 | 290 | ○ |
| 21 | Ga | 21 | 49 | 24 | 26 | 0.4a | 0.0a | 1 | 0.80 | 780b | 200 | 738 | 42 | X |
| 22 | Ha | 22a | 23a | 27 | 50 | 5.0 | 0.1a | 0 | 0.90 | 1210 | 200 | 1105b | 105 | X |
| 23 | Ia | 23 | 65 | 25 | 10 | 2.0a | 0.0a | 0 | 0.90 | 782b | 200 | 697 | 85 | X |
| 24 | Ja | 24 | 17a | 23 | 60a | 5.0 | 0.5a | 0 | 0.80 | 1230 | 200 | 1130b | 100 | X |
| 25 | K | 25 | 45 | 25 | 30 | 13.0 | 1.3 | 0 | 0.85 | 1040 | 200 | 760 | 280 | ○ |
| 26 | L | 26 | 46 | 24 | 30 | 13.1 | 1.3 | 0 | 0.85 | 1045 | 200 | 775 | 270 | ○ |
| 27 | M | 27 | 44 | 25 | 31 | 13.0 | 1.3 | 0 | 0.85 | 1043 | 200 | 768 | 275 | ○ |
| 28 | N | 28 | 44 | 26 | 30 | 14.0 | 1.3 | 0 | 0.85 | 1045 | 200 | 755 | 290 | ○ |
| 29 | O | 29 | 42 | 26 | 32 | 12.0 | 1.2 | 0 | 0.85 | 1030 | 200 | 770 | 260 | ○ |

TABLE 4-continued (continued from Table 3)

| | | | Microstructure | | | | | | | Mechanical properties | | | | |
|---|---|---|---|---|---|---|---|---|---|---|---|---|---|---|
| | Steel | Heat | Area fraction (%) | | | | | | | Room Temperature | Warm forming | | | |
| Steel No. | grade symbol | treatment No. | BF | α | M + $\gamma_R$ | $\gamma_R$ | $\gamma_R$ in α grains | Others | $C\gamma_R$ (mass %) | TS (MPa) | Temperature (° C.) | TS (MPa) | ΔTS (MPa) | Evaluation |
| 30 | P | 30 | 44 | 25 | 31 | 13.1 | 1.3 | 0 | 0.85 | 1043 | 200 | 763 | 280 | ○ |
| 31 | Q | 31 | 47 | 23 | 30 | 14.0 | 1.1 | 0 | 0.86 | 1040 | 200 | 775 | 265 | ○ |

(Index a: out of the range of the present invention, Index b: out of the recommended range BF: bainitic ferrite, α: ferrite, M: martensite, $\gamma_R$: retained austenite, ΔTS = room temperature TS − warm forming TS ○: [room temperature TS ≥980 MPa] and [warm forming TS ≤780 MPa], X: not satisfying the conditions "○")

As shown in the tables, all Steel Nos. 1 to 3, 7, 15 to 17, 19, 20, and 25 to 31 are steel sheets of the present invention satisfying the requirements defined for the microstructure of the present invention produced by using the steel grades satisfying the range of the chemical composition of the present invention under the recommended heat treatment conditions, and high strength steel sheets with excellent warm formability satisfying the evaluation standards both for the room temperature strength and the warm forming strength were obtained.

On the contrary, Steels Nos. 4 to 6, 8 to 14, 18, and 21 to 24 are comparative steel sheets not satisfying at least one of the requirements of the chemical composition and the microstructure defined in the present invention and do not satisfy the evaluation standards for at least one of the room temperature strength and the warm forming strength.

For example, in Steel Nos. 4 and 5, since the heating temperature HR1 for 600° C. to $Ac_1$ is too low, the recrystallization ratio X is too high, formation of austenite in the ferrite grains is suppressed, $\gamma_R$ present in the ferrite grains is decreased, so that both the room temperature strength and the effect of reducing the load during warm forming are insufficient.

In Steel No. 6, since the soaking temperature T1 is too low, the ferrite proportion becomes excessively high and the room temperature strength is insufficient.

In Steel No. 8, since the soaking temperature T1 is too high, ferrite is not formed and, accordingly, $\gamma_R$ is no more present in the ferrite grains and the effect of reducing the load during warm forming is insufficient although the room temperature strength is ensured.

In Steel No. 9, since the average cooling rate CR1 from the soaking temperature T1 to the super cooling temperature T2 is too low, the ferrite proportion is too high and the room temperature strength is insufficient.

In Steel No. 10, since the super cooling temperature T2 is too low, carbon concentration ($C\gamma_R$) of $\gamma_R$ in the final microstructure ($C\gamma_R$) is too high and the effect of reducing the load during warm forming is insufficient.

On the other hand, in Steel No. 11, since the super cooling temperature T2 is too high, bainite transformation does not proceed sufficiently and the $\gamma_R$ proportion in the final microstructure is lowered and the amount of $\gamma_R$ present in the ferrite grains is also decreased excessively and the effect of reducing the load during warm forming is insufficient.

In Steel No. 12, since the holding time t2 at the super cooling temperature T2 is excessively short, bainite transformation does not proceed sufficiently and the $\gamma_R$ proportion in the final microstructure is lowered, so that the $\gamma_R$ present in the ferrite grains is also decreased excessively and the effect of reducing the load during warm forming is insufficient.

In Steel No. 13, since the reheating temperature T3 is too high, the $\gamma_R$ proportion in the final microstructure is lowered excessively and the amount of $\gamma_R$ present in the ferrite grains is also decreased excessively, so that both the room temperature strength and the effect of reducing the load during warm forming are insufficient.

In Steel No. 14, since the holding time t3 at the reheating temperature T3 is too long, the $\gamma_R$ proportion in the final microstructure is lowered excessively and the $\gamma_R$ present in the ferrite grains is also decreased excessively, so that both the room temperature strength and the effect of reducing the load during warm forming are insufficient in the same manner as in the Steel No. 13.

In Steel No. 18, since the C content is too low, the $\gamma_R$ proportion in the final microstructure is lowered excessively and $\gamma_R$ present in the ferrite grains is also decreased excessively, so that the effect of reducing the load during warm forming is insufficient.

Further, in Steel No. 21, since the Si content is too low, the $\gamma_R$ proportion in the final microstructure is lowered excessively and $\gamma_R$ present in the ferrite grains is also decreased excessively, so that the room temperature strength is insufficient.

On the other hand, in Steel No. 22, since the Si content is too high and the recrystallization ratio X is also too high, $\gamma_R$ present in the ferrite grains is decreased excessively, so that the effect of reducing the load during warm forming is insufficient.

Further in Steel No. 23, since the Mn content is too low, the $\gamma_R$ proportion in the final microstructure is lowered excessively, so that the room temperature strength is insufficient.

On the other hand, in Steel No. 24, since the Mn content is too high, $\gamma_R$ present in the ferrite grains is decreased excessively, so that the effect of reducing the load during warm forming is insufficient.

By the way, FIG. 1 exemplifies the distribution states of $\gamma_R$ in the microstructure of the steel sheet according to the present invention (Steel No. 2) and the comparative steel sheet (Steel No. 5). FIG. 1 shows the result of EBSP observation in which white granulates are $\gamma_R$. In view of the FIGURE, it is apparent that $\gamma_R$ is scarcely present in the ferrite (α) grains for the comparative steel sheet (Steel No. 5), whereas $\gamma_R$ is present in a great amount in the ferrite (α) grains in the steel sheet according to the present invention (Steel No. 2).

While the present invention has been described specifically with reference to specific embodiments, it will be apparent to persons skilled in the art that various modifications or changes can be made without departing from the spirit and the scope of the present invention.

The present application is based on the Japanese Patent Application (Patent Application No. 2012-044068) filed on Feb. 29, 2012, the content of which is incorporated herein for reference.

INDUSTRIAL APPLICABILITY

The present invention is suitable, for example, as thin steel sheets for use in framework components of automobiles.

The invention claimed is:

1. A steel sheet, comprising:
C: from 0.05 mass % to 0.3 mass %;
Si: from 1 mass % to 3 mass %;
Mn: from 0.5 mass % to 3 mass %;
P: from 0 mass % to 0.1 mass %;
S: from 0 mass % to 0.01 mass %;
Al: from 0.001 mass % to 0.1 mass %; and
N: from 0.002 mass % to 0.03 mass %,
the balance being iron and impurities;
wherein the steel sheet has a microstructure which comprises, in terms of an area fraction relative to the total microstructure area:
bainitic.ferrite: from 40 to 85%,
retained austenite: from 5 to 20%,
martensite and retained austenite: from 10 to 50%, and
ferrite: from 9 to 40%,
the retained austenite has from 0.5 to 1.0 mass % of a C concentration ($C\gamma_R$), and
an amount of the retained austenite present in ferrite grains is 1% or more in terms of the area fraction relative to the total microstructure area.

2. The steel sheet according to claim 1, further comprising one or more of:
Cr: from 0.01 mass % to 3 mass %,
Mo: from 0.01 mass % to 1 mass %,
Cu: from 0.01 mass % to 2 mass %,
Ni: from 0.01 mass % to 2 mass %,
B: from 0.00001 mass % to 0.01 mass %,
Ca: from 0.0005 mass % to 0.01 mass %,
Mg: from 0.0005 mass % to 0.01 mass %, and
REM: from 0.0001 mass % to 0.01 mass %.

3. The high strength steel sheet according to claim 1, wherein the microstructure comprises, in terms of the area fraction relative to the total microstructure area:
bainitic.ferrite: from 40 to 65%,
retained austenite: from 10 to 20%,
martensite and retained austenite: from 20 to 40%, and
ferrite: from 9 to 30%.

4. The steel sheet according to claim 1, wherein the steel sheet consists of iron, C, Si, Mn, P, S, Al, N, and impurities.

5. The steel sheet according to claim 1, wherein
an amount of C is from 0.10 mass % to 0.3 mass %,
an amount of Si is from 1.1 mass % to 2.5 mass %,
an amount of Mn is from 0.7 mass % to 2.5 mass %,
an amount of P is from 0 mass % to 0.03 mass %, and
an amount of S is from 0 mass % to 0.008 mass %.

6. The steel sheet according to claim 1, wherein the microstructure comprises, in terms of the area fraction relative to the total microstructure area:
bainitic.ferrite: from 40 to 75%,
retained austenite: from 7 to 20%,
martensite and retained austenite: from 15 to 45%, and
ferrite: from 9 to 35%.

7. The steel sheet according to claim 1, further comprising one or more of:
Cr: from 0.02 mass % to 2.0 mass %,
Mo: from 0.02 mass % to 0.8 mass %,
Cu: from 0.1 mass % to 1.0 mass %,
Ni: from 0.1 mass % to 1.0 mass %,
B: from 0.0002 mass % to 0.0030 mass %,
Ca: from 0.001 mass % to 0.003 mass %,
Mg: from 0.001 mass % to 0.003 mass %, and
REM: from 0.0002 mass % to 0.006 mass %.

8. The steel sheet according to claim 1, further comprising one or more of:
Cr: from 0.01 mass % to 3 mass %,
Mo: from 0.01 mass % to 1 mass %,
Cu: from 0.01 mass % to 2 mass %,
Ni: from 0.01 mass % to 2 mass %, and
B: from 0.00001 mass % to 0.01 mass %.

9. The steel sheet according to claim 1, further comprising one or more of:
Ca: from 0.0005 mass % to 0.01 mass %,
Mg: from 0.0005 mass % to 0.01 mass %, and
REM: from 0.0001 mass % to 0.01 mass %.

10. The steel sheet according to claim 8, further comprising one or more of:
Ca: from 0.0005 mass % to 0.01 mass %,
Mg: from 0.0005 mass % to 0.01 mass %, and
REM: from 0.0001 mass % to 0.01 mass %.

11. The steel sheet according to claim 1, further comprising from 0.0005 mass % to 0.01 mass % of Ca.

12. The steel sheet according to claim 1, further comprising from 0.0005 mass % to 0.01 mass % of Mg.

13. The steel sheet according to claim 1, further comprising from 0.01 mass % to 3 mass % of Cr.

14. The steel sheet according to claim 1, further comprising from 0.01 mass % to 1 mass % of Mo.

15. The steel sheet according to claim 1, further comprising from 0.01 mass % to 2 mass % of Cu.

16. The steel sheet according to claim 1, further comprising from 0.01 mass % to 2 mass % of Ni.

* * * * *